US010912399B2

(12) United States Patent
Cianchino

(10) Patent No.: US 10,912,399 B2
(45) Date of Patent: Feb. 9, 2021

(54) STANDS TO HOLD MODEL OBJECTS

(71) Applicant: Mathew Cianchino, Maspeth, NY (US)

(72) Inventor: Mathew Cianchino, Maspeth, NY (US)

( * ) Notice: Subject to any disclaimer, the term of this patent is extended or adjusted under 35 U.S.C. 154(b) by 0 days.

(21) Appl. No.: 16/486,679

(22) PCT Filed: Feb. 17, 2018

(86) PCT No.: PCT/US2018/018535
§ 371 (c)(1),
(2) Date: Aug. 16, 2019

(87) PCT Pub. No.: WO2018/152433
PCT Pub. Date: Aug. 23, 2018

(65) Prior Publication Data
US 2020/0008588 A1 Jan. 9, 2020

Related U.S. Application Data

(60) Provisional application No. 62/460,464, filed on Feb. 17, 2017.

(51) Int. Cl.
*A47F 3/14* (2006.01)
*A47F 3/00* (2006.01)
*A47F 11/10* (2006.01)

(52) U.S. Cl.
CPC ..... *A47F 3/14* (2013.01); *A47F 3/001* (2013.01); *A47F 11/10* (2013.01)

(58) Field of Classification Search
CPC ..... A47F 3/14; A47F 3/001; A47F 11/10
USPC ... 108/180, 185, 137, 65, 108, 101, 102, 23, 108/1, 9; 312/114, 119, 122, 261; 211/162
See application file for complete search history.

(56) References Cited

U.S. PATENT DOCUMENTS

| | | | | | |
|---|---|---|---|---|---|
| 439,186 | A * | 10/1890 | Reams | A47B 27/02 | 108/9 |
| 1,257,843 | A * | 2/1918 | Gonyea | A47B 35/00 | 108/93 |
| 2,441,721 | A * | 5/1948 | Schroeder | A47B 96/027 | 108/30 |
| 3,556,023 | A * | 1/1971 | Marschak | A47B 57/045 | 108/1 |
| 3,677,203 | A | 7/1972 | Barrineau | | |
| 3,715,815 | A * | 2/1973 | Lewis | A47B 13/16 | 434/429 |
| 4,148,533 | A * | 4/1979 | Bustos | G09F 23/06 | 108/23 |

(Continued)

FOREIGN PATENT DOCUMENTS

| | | | |
|---|---|---|---|
| CN | 205125739 | U | 4/2016 |
| RU | 2263979 | C2 | 11/2005 |

OTHER PUBLICATIONS

International Search Report dated Jun. 28, 2018 issued in PCT/US2018/018535.

*Primary Examiner* — Jose V Chen
(74) *Attorney, Agent, or Firm* — Scully, Scott, Murphy & Presser, P.C.

(57) ABSTRACT

The present disclosure is directed to a stand that includes a base; a back operably connected to the base; and at least one extendable side support, wherein the at least one extendable side support is configured to slidably move horizontally in relation to the base.

8 Claims, 11 Drawing Sheets

(56) References Cited

U.S. PATENT DOCUMENTS

| | | | | | |
|---|---|---|---|---|---|
| 4,460,097 | A * | 7/1984 | Darnell, II | A47F 7/145 | 211/189 |
| 4,526,110 | A * | 7/1985 | Franz | A47F 5/103 | 108/108 |
| 4,620,489 | A * | 11/1986 | Albano | A47B 96/025 | 108/105 |
| 4,776,472 | A * | 10/1988 | Rosen | A47B 96/025 | 108/102 |
| 5,979,337 | A * | 11/1999 | Clark | A47B 23/06 | 108/23 |
| 6,454,064 | B1 * | 9/2002 | Cheng | A45C 9/00 | 190/11 |
| 7,784,414 | B1 * | 8/2010 | Torres | A47B 45/00 | 108/73 |
| 7,987,799 | B2 * | 8/2011 | Lange | A47B 45/00 | 108/102 |
| 8,033,229 | B1 * | 10/2011 | McCanna | F16M 11/10 | 108/1 |
| 8,939,091 | B2 * | 1/2015 | Suzuki | A47F 5/10 | 108/106 |
| 9,936,825 | B1 * | 4/2018 | Lindblom | A47F 5/0087 | |
| 2011/0232535 | A1 * | 9/2011 | Hung | A61B 50/13 | 108/25 |
| 2014/0109515 | A1 | 4/2014 | Cigana et al. | | |
| 2016/0007732 | A1 * | 1/2016 | Arne | A47B 13/12 | 108/23 |

* cited by examiner

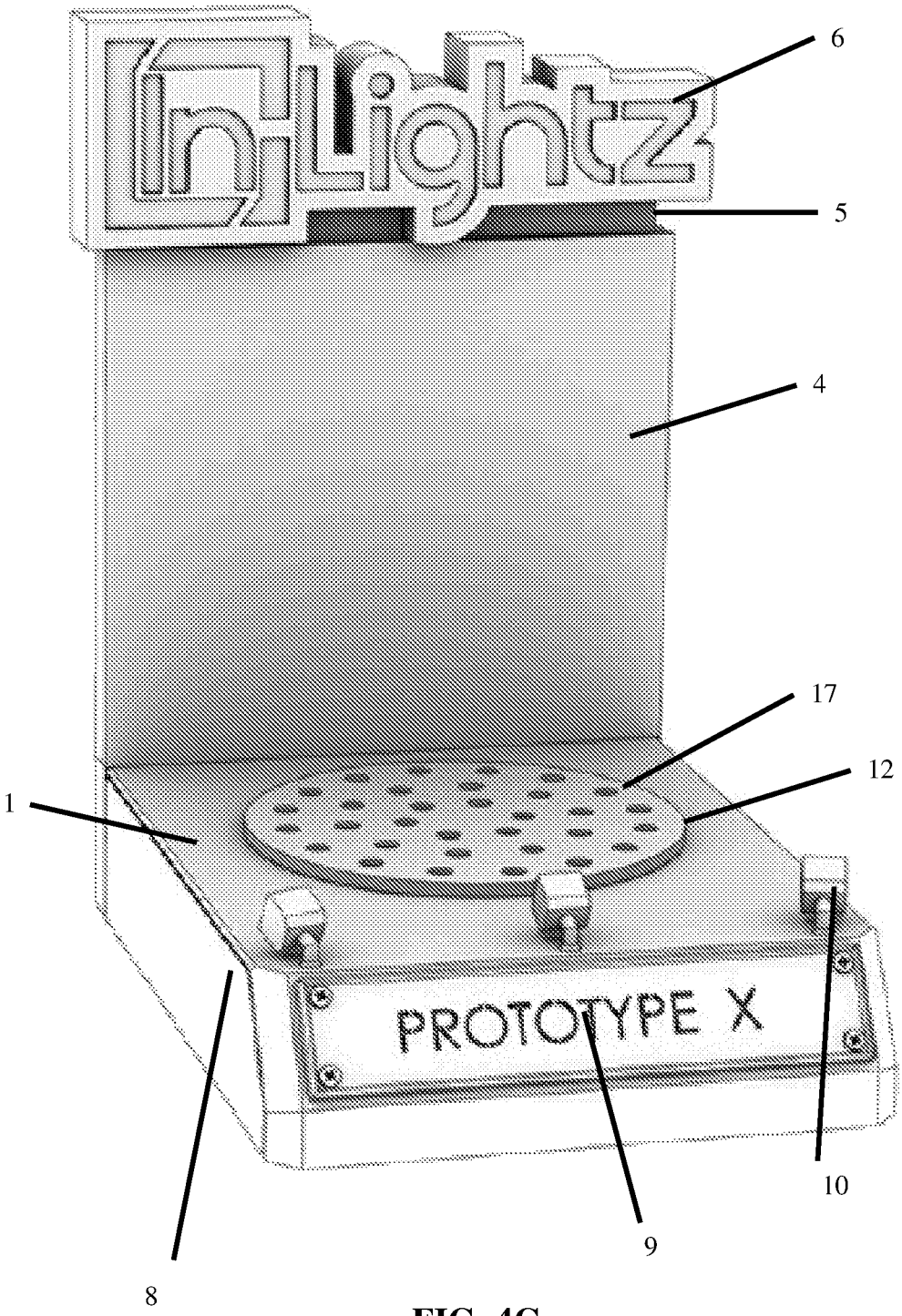
FIG. 4C
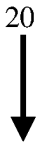

STANDS TO HOLD MODEL OBJECTS

CROSS REFERENCE TO RELATED APPLICATIONS

The present Application claims priority to Provisional Application No. 62/460,464, filed on Feb. 17, 2017, the entire contents of which are incorporated by reference.

BACKGROUND OF THE DISCLOSURE

The present application relates stands that can support and/or hold various materials. For example, the stands can support and/or hold model figurines and model automobiles.

Known stands have several shortcomings, such as lack of customizability and lack of adjustment.

Thus, a stand that is adjustable and is configured to and capable of supporting and/or holding various materials is desired.

SUMMARY OF THE DISCLOSURE

The present disclosure is directed to a stand that includes a base; a back operably connected to the base; and at least one extendable side support, wherein the at least one extendable side support is configured to slidably move horizontally in relation to the base.

BRIEF DESCRIPTION OF THE DRAWINGS

The present disclosure will be better understood by reference to the following drawings of which:

FIG. 4C is a perspective view of an embodiment of a stand;

DETAILED DESCRIPTION

Figure 1A:
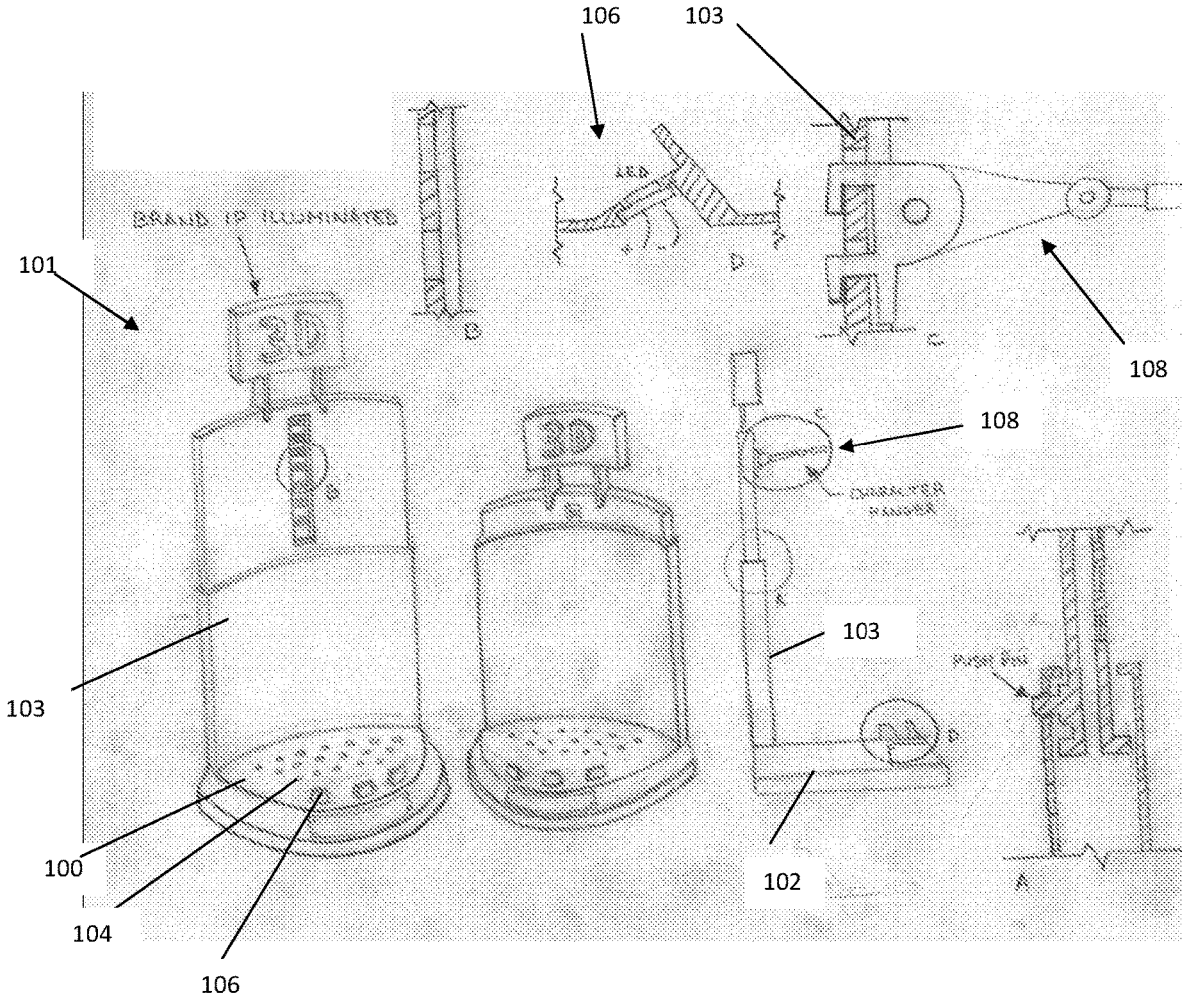
FIG. 1A is a view of a figure stand.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

In the following description, numerous specific details are set forth, such as particular structures, components, materials, dimensions, processing steps and techniques, in order to provide an understanding of the various embodiments of the present application. However, it will be appreciated by one of ordinary skill in the art that the various embodiments of the present application may be practiced without these specific details. In other instances, well-known structures or processing steps have not been described in detail in order to avoid obscuring the present application.

It will be understood that when an element as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "beneath" or "under" another element, it can be directly beneath or under the other element, or intervening elements may be present. In contrast, when an element is referred to as being "directly beneath" or "directly under" another element, there are no intervening elements present.

In the discussion and claims herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

As used herein, the term "substantially", or "substantial", is equally applicable when used in a negative connotation to refer to the complete or near complete lack of an action, characteristic, property, state, structure, item, or result. For example, a surface that is "substantially" flat would either be completely flat, or so nearly flat that the effect would be the same as if it were completely flat.

As used herein terms such as "a", "an" and "the" are not intended to refer to only a singular entity, but include the general class of which a specific example may be used for illustration.

As used herein, terms defined in the singular are intended to include those terms defined in the plural and vice versa.

Reference herein to any numerical range expressly includes each numerical value (including fractional numbers and whole numbers) encompassed by that range. To illustrate, reference herein to a range of "at least 50" or "at least about 50" includes whole numbers of 50, 51, 52, 53, 54, 55, 56, 57, 58, 59, 60, etc., and fractional numbers 50.1, 50.2 50.3, 50.4, 50.5, 50.6, 50.7, 50.8, 50.9, etc. In a further illustration, reference herein to a range of "less than 50" or "less than about 50" includes whole numbers 49, 48, 47, 46, 45, 44, 43, 42, 41, 40, etc., and fractional numbers 49.9, 49.8, 49.7, 49.6, 49.5, 49.4, 49.3, 49.2, 49.1, 49.0, etc. In yet another illustration, reference herein to a range of from "5 to 10" includes whole numbers of 5, 6, 7, 8, 9, and 10, and fractional numbers 5.1, 5.2, 5.3, 5.4, 5.5, 5.6, 5.7, 5.8, 5.9, etc.

Each element of the disclosed stands can be made of any suitable material that can maintain a structural form, such as plastics, elastomers, metals, carbon based materials, and mixtures thereof. Further, each of the materials can be modified to increase and decrease their rigidity, as desired.

One embodiment of the present application is directed to stands that hold and/or support figures, such as figurines, statues, characters, busts and models. For discussion purposes in this application, the term figures will be used but this term is inclusive of all other terms listed above.

As can be seen from the following figures, each stand includes the ability to adjust the height to fit different size and/or scale of the figures. There is a design of cavities in the base of the stand, the design is configured to accept a peg or extending element from the figures. The stand includes an adjustable arm element that can be included to suspend the figure in the air above the base of the stand. The stand can optionally include a lit area to provide light to the front and/or the back of a symbol or emblem that can be associated with the figure. Also, the stand can optionally include an area to include the name of the figure, which can be lit from the front and/or back of the name as well.

Representative views of the figure stand 101 are shown in FIG. 1A. As can be seen from this figure the base 102 includes cavities 104 and lights 106 that provide light to the figure (not shown). The bottom left view of FIG. 1A illustrates the stand in an expanded configuration while the stand to the right of the bottom left view illustrates the stand in a collapsed configuration. These configurations can be adjusted based on the height of the figure by placing the push pin (shown in "A"-bottom right corner" into varying cavities along the height of the support portion back 103.

The area circled as "B" in the figure stand 101 is illustrated in further detail above and allows for attachment of the adjustable arm element 108. Adjustable arm element 108 can operably attach to the support portion back 103, and can articulate in any direction. Adjustable arm element 108 can also include teeth or another mechanism to lock one or more of the articulating joints, such as those shown in FIG. 1B. The distal end of adjustable arm element 108 is configured to hold and/or support a figure or any other apparatus.

Figure 1B:
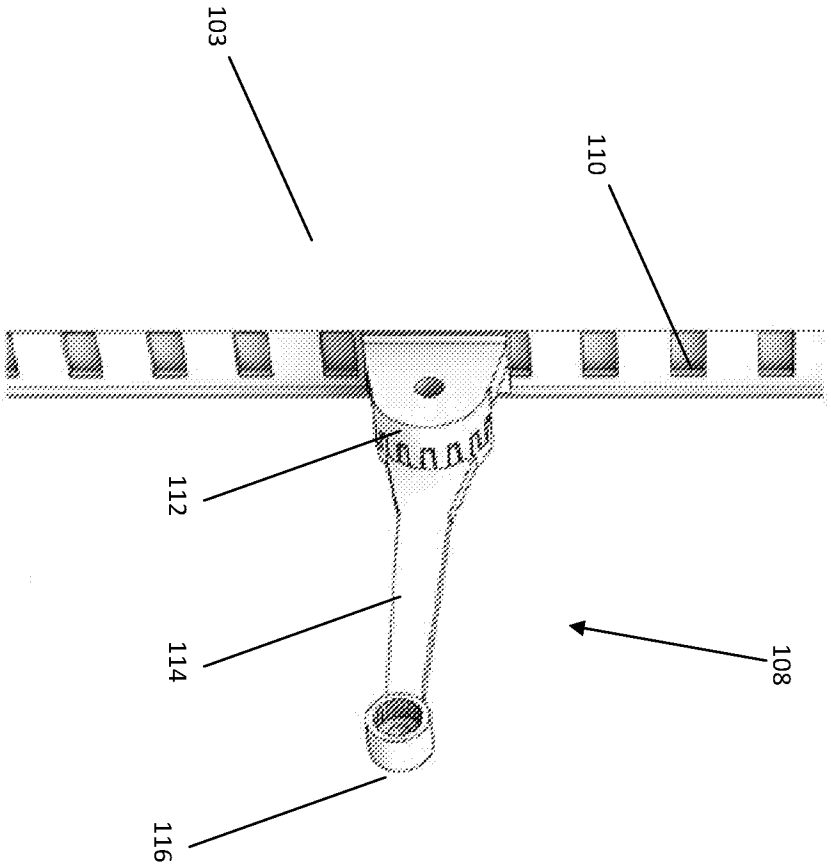
FIG. 1B is a magnified view of an adjustable arm element.

FIG. 1B provides a magnified view of adjustable arm element 108, at it is attached to support portion back 103. The support portion back 103 can include one or more tabbed openings 110, at varying heights from the base of the figure stand. The attachment portion 112 of the adjustable arm element 108 is configured to temporarily or permanently attach to the tabbed openings 110 though any suitable mechanical connection. The adjustable arm element 108 further comprises a rotatable arm 114, which rotates with respect to the attachment portion 112 about an axis. The rotatable arm 114 can be rotatably fixed about the axis with respect to the attachment portion 112 by a ratchet interaction between the rotatable arm 114 and the attachment portion 112.

On the opposing end of rotatable arm 114, a fastening element 116 can be included, which can be hollow, with an inner surface having ratcheting features. The fastening element 116 is configured to fasten a figure or other apparatus to the adjustable arm element in a fixed position.

Figure 2:
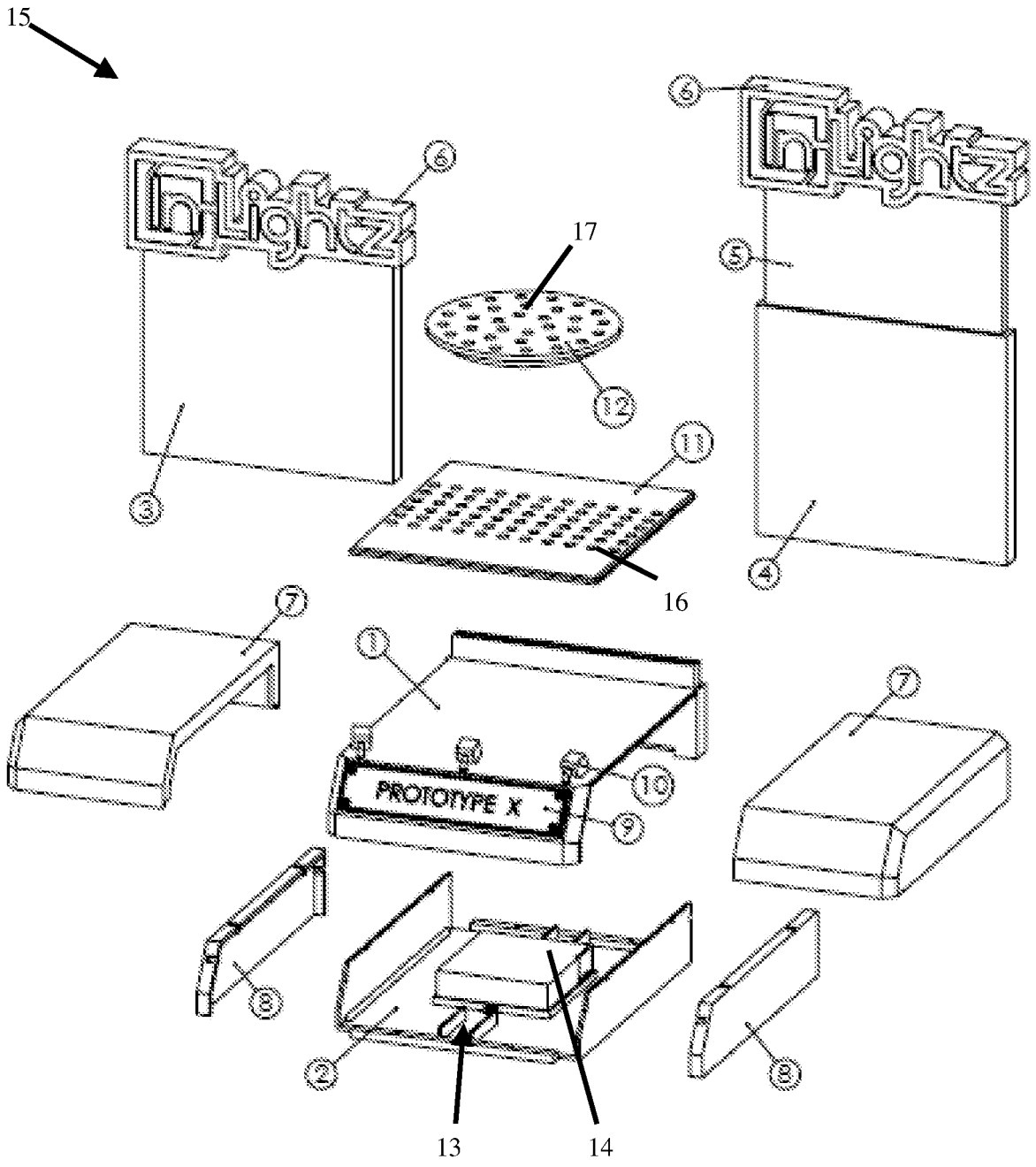
FIG. 2 is an exploded, perspective view of a stand.

FIG. 2 is an exploded, perspective view of an embodiment of a stand 15. The stand comprises a base 1. The base 1 can operably attach to a bottom cover 2. One or more side covers 8 (two shown in FIG. 2) can operably attach to one or two opposing sides of bottom cover 2. Although not clear from this figure, a space is left between the one or more side covers 8 and the base 1 when stand 15 is assembled. This space allows for at least one extendable side support 7 (with two being shown in FIG. 2) to slidably move horizontally in relation to the base 1. This varying horizontal position will be illustrated in the figures and will be described below.

Although one stand 15 is shown in the figures, two or more stands can be placed next to or near each other, or two or more stands can be operably attached to each other.

On one surface of the base 1 an optional plaque 9 can be operably attached, permanently or temporarily, through any suitable beans. This plaque 9 can be configured to state any message or display any design.

The base 1 can optionally include one or more light sources 10 (3 shown in FIG. 2) that extend from a surface of the base 1. These light sources 10 are adjustable in both the vertical and horizontal plane, and can maintain a fixed vertical and horizontal position upon a manual adjustment.

The base 1 can also support an optional platform 11. The platform 11 can be any suitable shape, such as the shape in FIG. 2 to substantially cover the upper surface of the base 1. The platform 11 can include a number of openings 16 that are themselves configured to receive a peg or other extension from a figure or apparatus.

In other embodiments, the base 1 can support an optional platform 12, which is configured to rotate in relation to the base 1. The platform 12 can include a number of openings 17 that are themselves configured to receive a peg or other extension from a figure or apparatus.

In yet other embodiments, the base 1 itself can include a number of openings (not shown) that are themselves configured to receive a peg or other extension from a figure or apparatus.

The stand 15 further comprises a back 3, which is operably connected to the base 1. The back 3 is configured to include or support or display any suitable design, such as for example logo 6.

In other embodiments an adjustable back 4 can be operably connected to the base. The adjustable back 4 comprises an extendable back 5, the extendable back 5 being configured to move vertically as compared to the base 1 and the adjustable back 4, and can support or display any suitable design, such as for example logo 6.

The base 1, and bottom cover 2, can form a cavity 13 within their respective inner surfaces. This cavity 13 can be configured to contain a power supply 14, which can supply the lights 10 with electricity. The power supply 14 can comprise of one or more batteries and/or be configured to receive electrical energy from an external source.

Although light sources 10 are shown in the figures as extending from a surface of the base 1, in other embodiments lights can be in any suitable location and orientations, such as on adjustable back 4 and/or back 3 and/or logo 6.

Figure 3A:
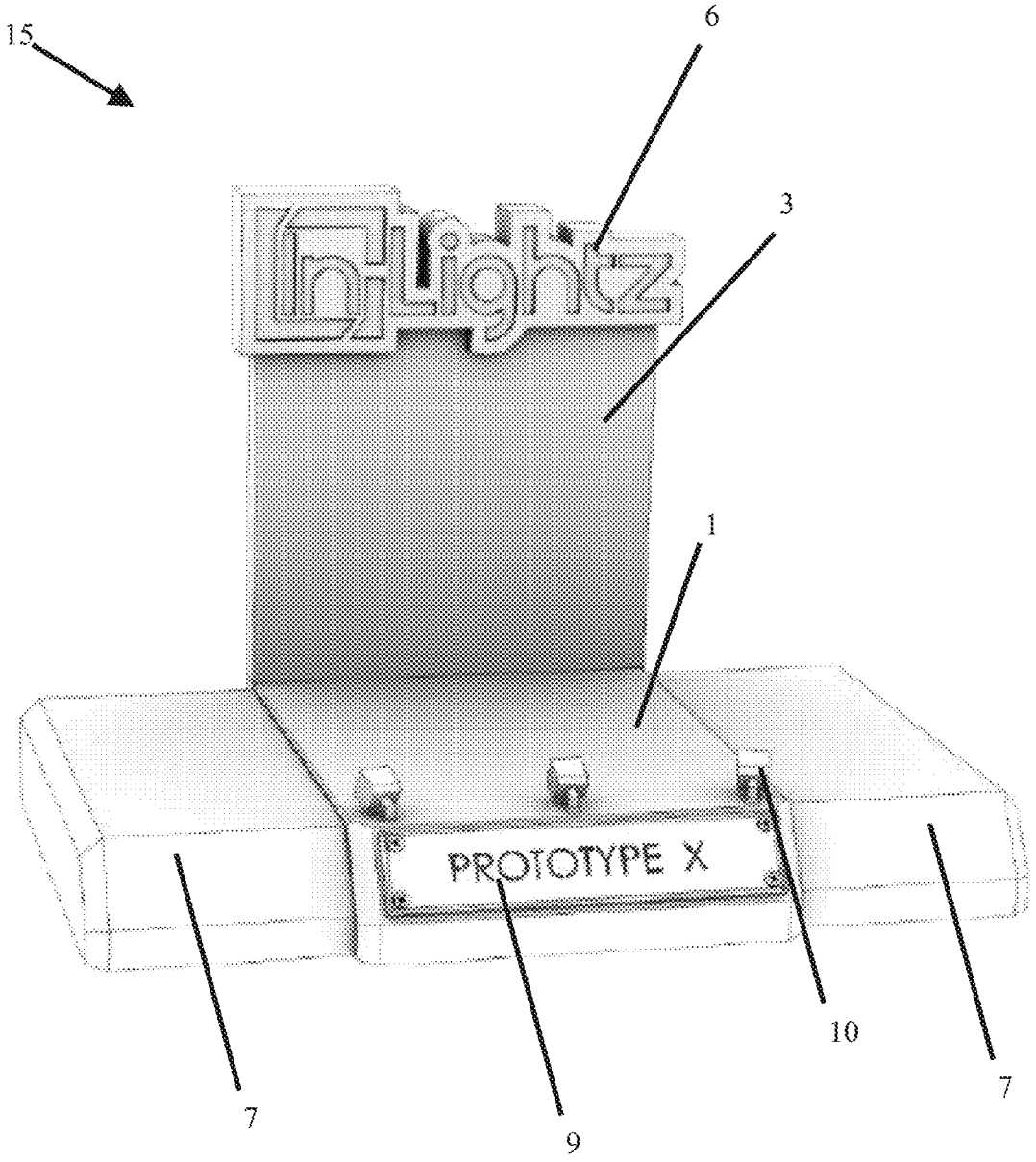
FIG. 3A is a perspective view of an embodiment of a stand.
Figure 3B:
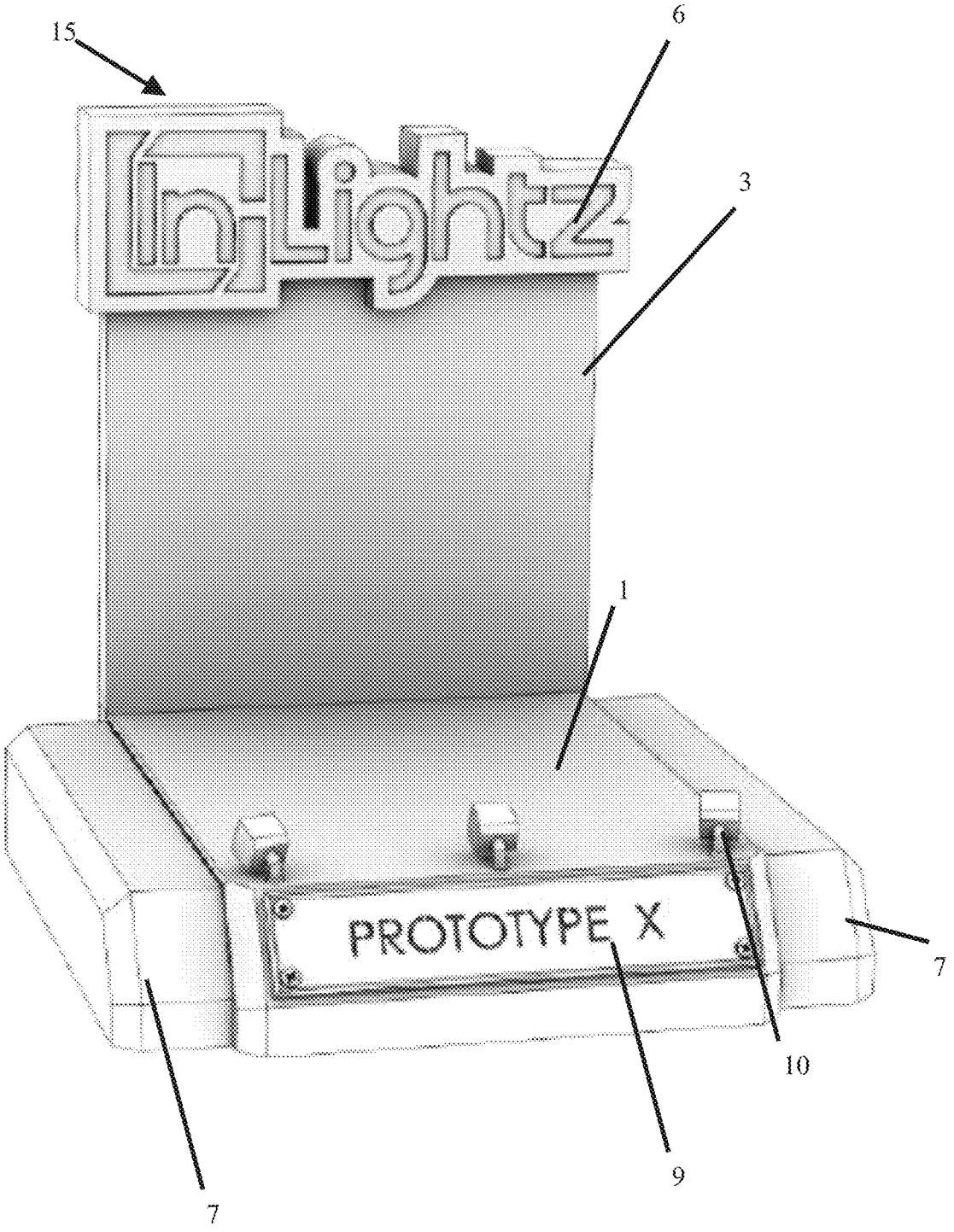
FIG. 3B is a perspective view of an embodiment of a stand.

In FIG. 3A an assembled stand 15 is shown. In this embodiment, each of the extendable side supports 7 are in an extended position, which is in contrast to FIG. 3B, which shows each of the extendable side supports 7 in a contracted position. To move each of the extendable side supports 7, a user can manually push or pull the extendable side support 7, through the space formed by the bottom surface of base 1 and the respective side cover (not shown but 8 of FIG. 2), causing the extendable side support 7 to move further into or out of the cavity (not shown, but 15 of FIG. 2). Although not shown in this FIG. 3B, or FIG. 2, each extendable side support 7 can include a catch, which can contact any portion of the side cover (not shown but 8 of FIG. 2) or the bottom cover (not shown but 2 of FIG. 2) to prevent the extendable side portion from being completely withdrawn from the cavity.

Figure 4A:
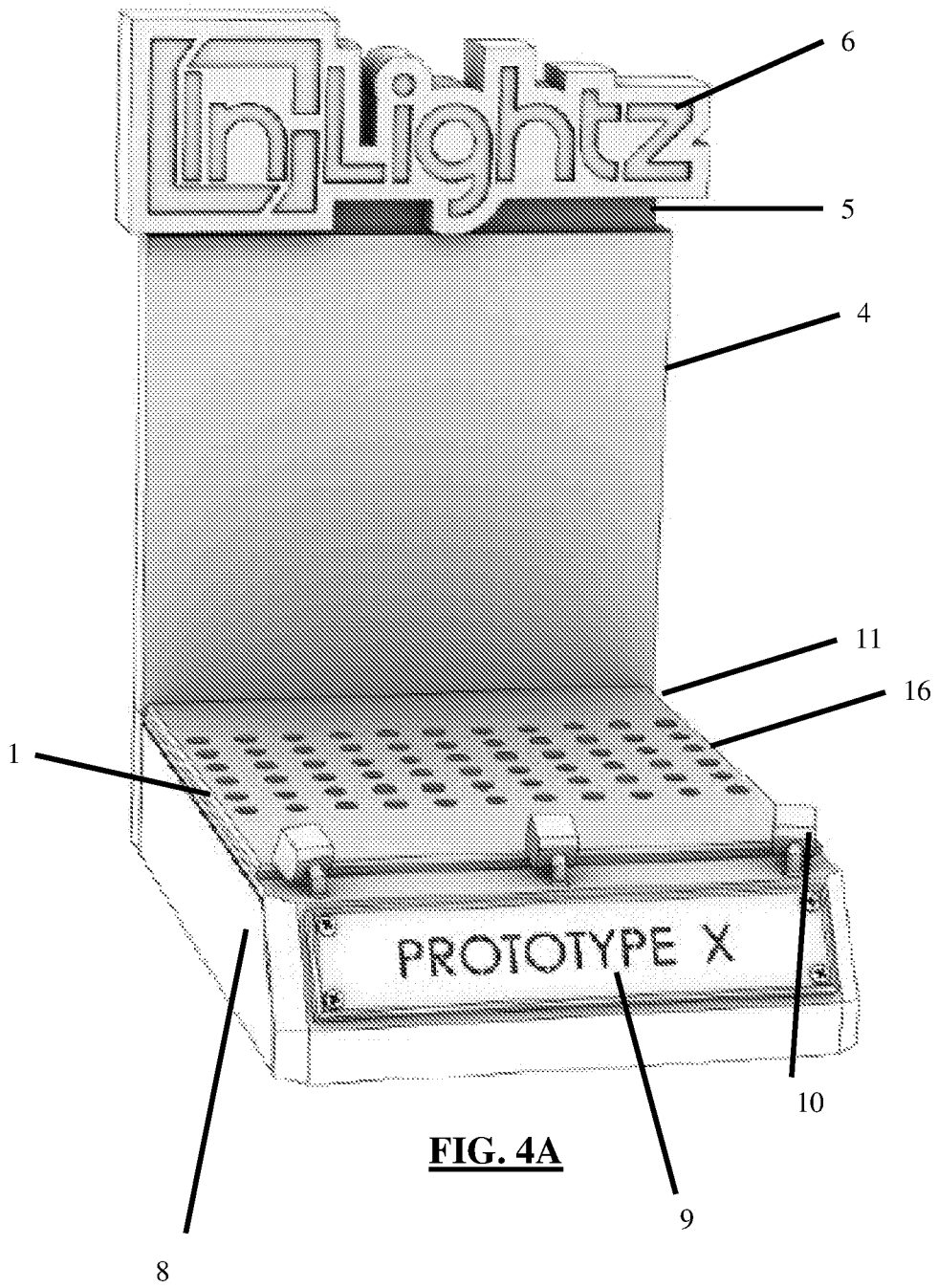
FIG. 4A is a perspective view of an embodiment of a stand.
Figure 4B:
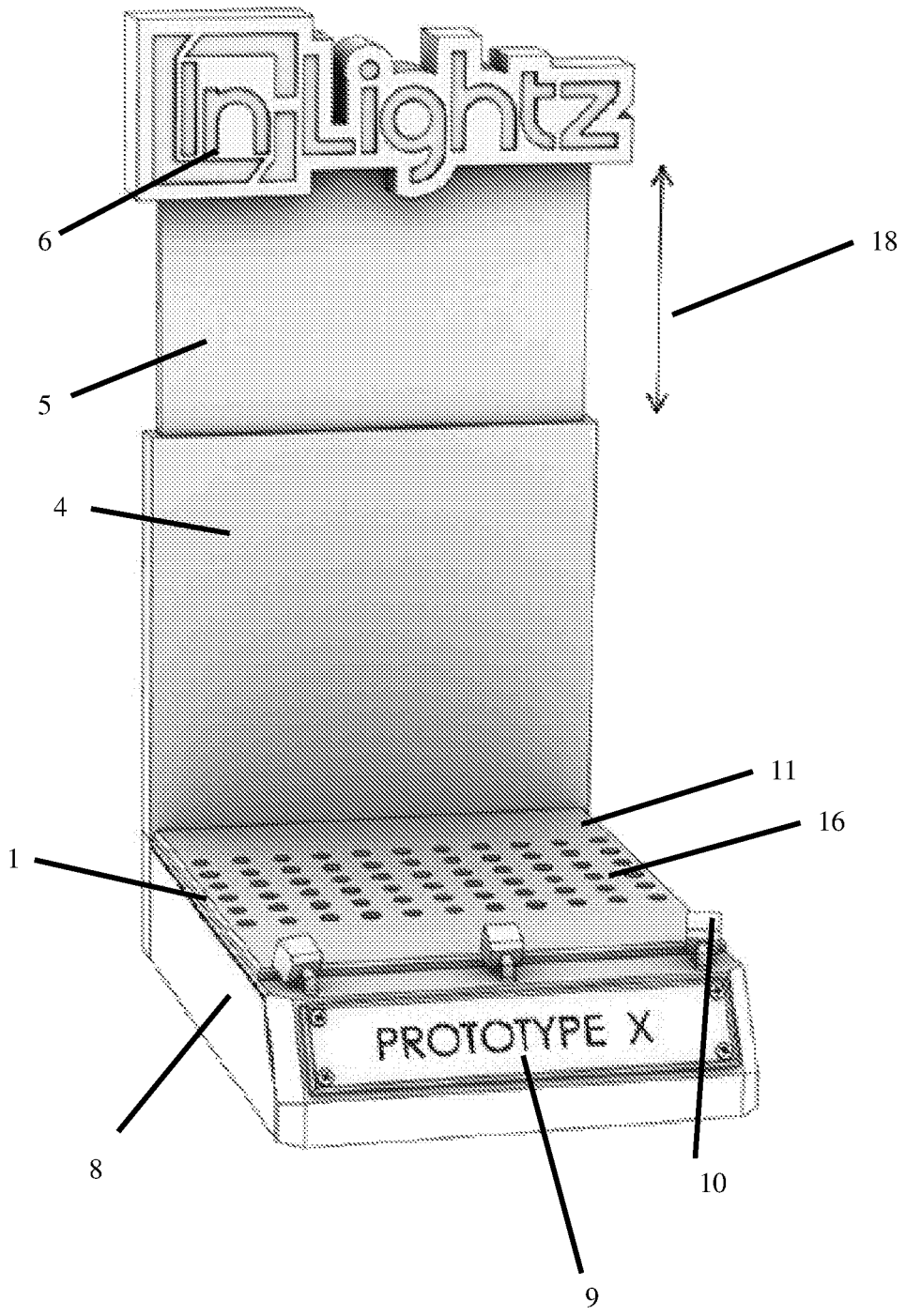
FIG. 4B is a perspective view of an embodiment of a stand.

In FIGS. 4A-4C, extendable side supports are not shown. In FIG. 4A, the platform 11 is shown, being supported by base 1. The platform 11 includes a plurality of openings 16 in a grid format, but in other embodiments, the plurality of openings 16 can be any number of openings, such as 1, 2, 3, 4, etc. and in any suitable design and location within platform 11.

In this embodiment, the adjustable back 4 is operably connected to the base, with the extendable back 5 shown in its lowest vertical configuration. In FIG. 4B, the extendable back 5 shown in its highest vertical configuration.

To move extendable back 5 vertically up and down, as indicated by arrow 18, a user can manually push and/or pull the extendable back 5 nearer or further from the base 1. Inside adjustable back 4 there are several catches and/or securing elements that are configured to interact with extendable back 5 and maintain extendable back 5 at various vertical heights.

In the embodiment of FIG. 4C, the platform 12, which is configured to rotate in relation to the base 1, is shown. The platform 12 can include a number of openings 17 that are themselves configured to receive a peg or other extension from a figure or apparatus. The platform 12 includes the plurality of openings 17 in a random format, but in other embodiments, the plurality of openings 17 can be any number of openings, such as 1, 2, 3, 4, etc. and in any suitable design and location within platform 12.

Figure 5A:
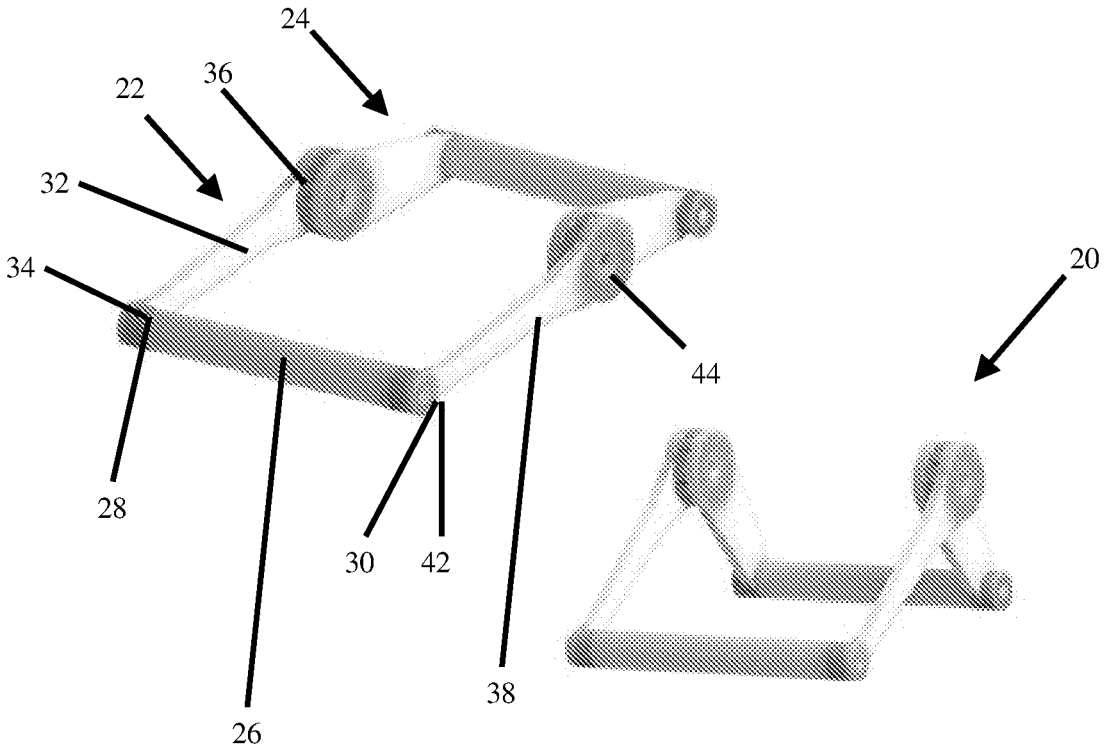
FIG. 5A is a perspective view of a tilt element.

In FIG. 5A a tilt element 20 is shown in two different configurations. Reference numbers are only included for one of the tilt elements 20 for explanatory and clarity purposes.

The tilt element 20 comprises a first member 22 and a second member 24. Each member, including the first member has a base leg 26 having a first base leg end 28 and a second base leg end 30, a first support leg 32 comprising a first support leg first end 34 and a first support leg second end 36, the first support leg first end 34 operably connected to the first base leg end 28.

Each member, including the first member also has a second support leg 38 comprising a second support leg first end 42 and a second support leg second end 44, the second support leg first end 42 operably connected to the second base leg end 30. In tilt element 20, each of the first support leg second end 36 and the second support leg second end 44 each comprise a ratchet, and wherein the two members (first member 22 and second member 24) are configured to attach to each other rotatably about the ratchet.

Figure 5B:
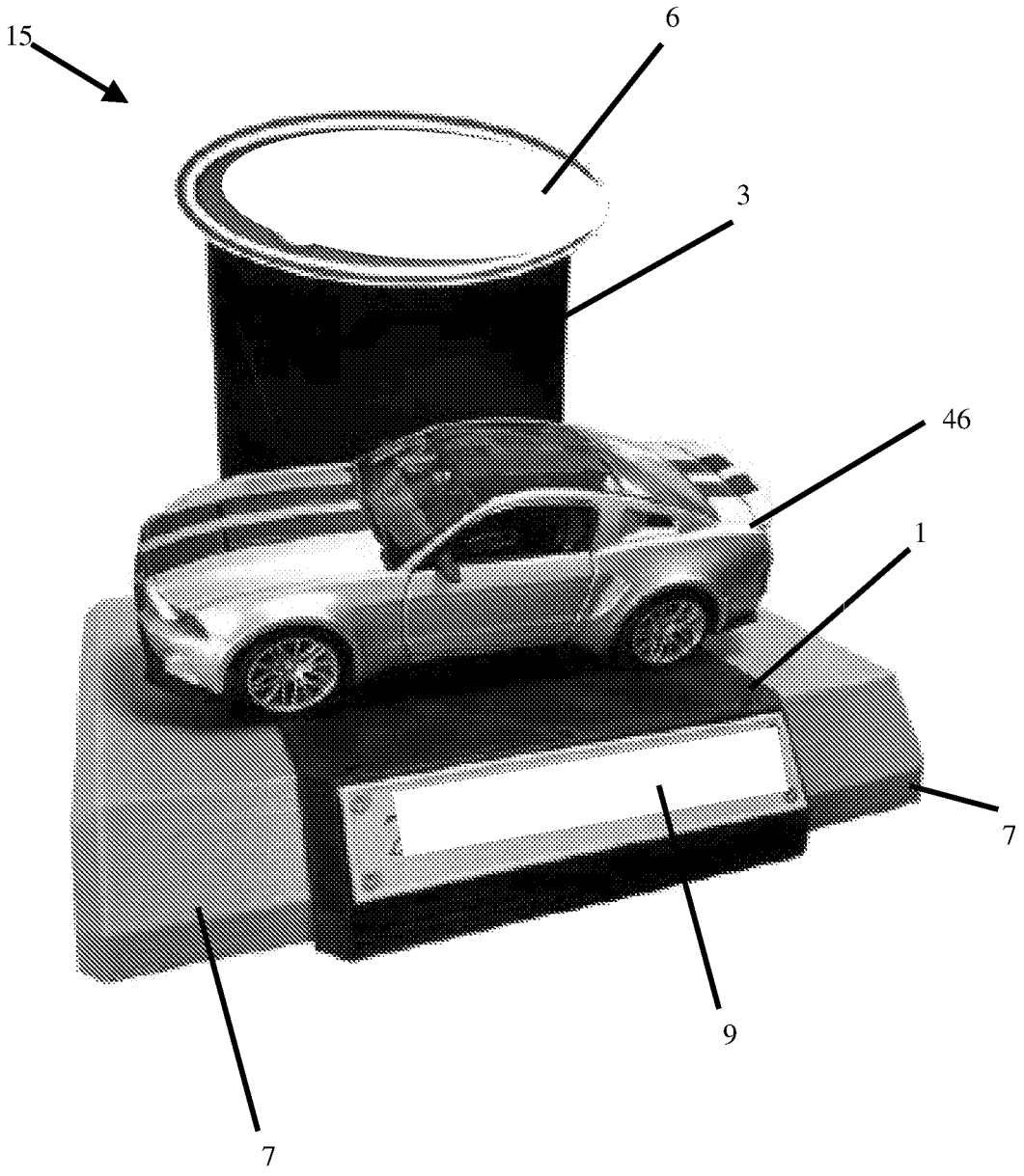
FIG. 5B is a perspective view of a stand with a tilt element.

In FIG. 5A, the tilt element 20 on the left side is arranged to provide less tilt to a figure or apparatus, the tilt element 20 on the right side is arranged to provide more tilt to a figure or apparatus, as further shown in FIG. 5B.

In FIG. 5B, the tilt element (not visible) is placed on the base 1, to cause figure 46 to tilt towards the user. If no tilt element were present, in this embodiment, all four tires of the figure 46 would be contacting the base 1, but since the tilt element is present, only the two driver side tires are in contact with the base 1, while the passenger side tires are elevated off of the base 1.

Figure 6:
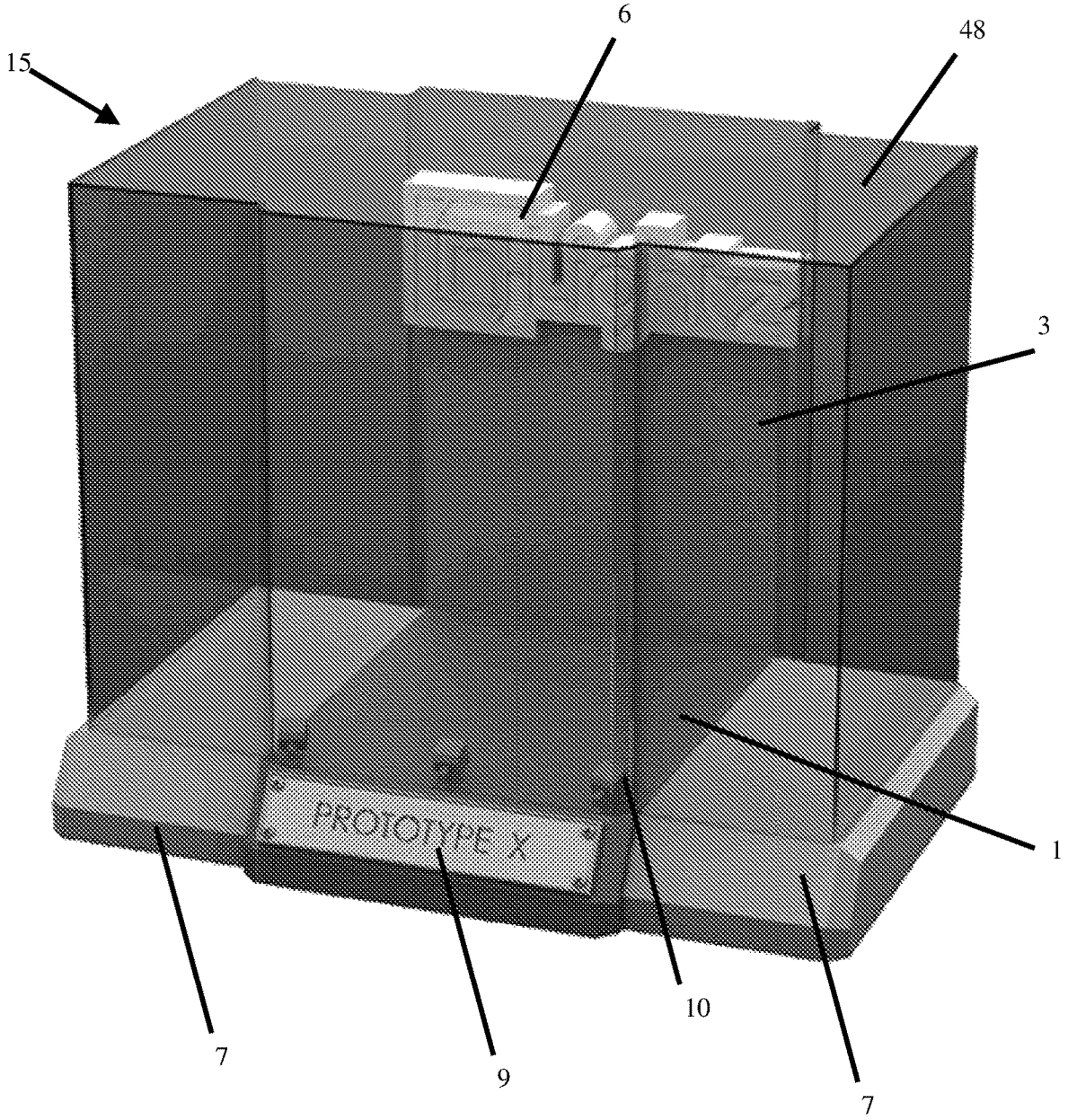
FIG. 6 is a perspective view of a stand with an optional case.

FIG. 6 is a perspective view of a stand 15, with an optional cover 48 extending over a majority of the base 1, and at least a portion of the extendable side support 7. Cover 48 can be made of any substantially translucent or substantially transparent material, such as a plastic. The cover 48 can be shaped to substantially align with the base 1 and each of extendable side support 7 (as shown in FIG. 6), or be any other suitable shape and height.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

The invention claimed is:

1. A stand, the stand comprising:

a base;

a back operably connected to the base;

at least one extendable side support, wherein the at least one extendable side support is configured to slidably move horizontally in relation to the base; and a tilt element, wherein the tilt element is configured to rest on the base, wherein the tilt element comprises two members, each member comprises a base leg having a first base leg end and a second base leg end, a first support leg comprising a first support leg first end and a first support leg second end, the first support leg first end operably connected to the first base leg end, a second support leg comprising a second support leg first end and a second support leg second end, the second support leg first end operably connected to the second base leg end, wherein each of the first support leg second end and the second support leg second end each comprising a ratchet, and wherein the two members are configured to attach rotatably about the ratchet.

2. The stand of claim 1, wherein the base comprises one or more openings configured to receive a peg.

3. The stand of claim 1, wherein at least two extendable side supports are configured to slidably move horizontally in relation to the base.

4. The stand of claim 1, wherein the back is configured to slidably move vertically in relation to the base.

5. The stand of claim 1, wherein the base comprises a cavity.

6. The stand of claim 1, wherein the base has one or more adjustable light sources extending from a surface of the base.

7. The stand of claim 1, wherein the base is configured to support a platform, wherein the platform comprises one or more openings configured to receive a peg.

8. The stand of claim 7, wherein the platform is rotatable in relation to the base.

* * * * *